United States Patent [19]

Miyazaki et al.

[11] Patent Number: 4,607,959

[45] Date of Patent: Aug. 26, 1986

[54] VANED STIRRER FOR USE IN HIGH TEMPERATURE ATMOSPHERE

[75] Inventors: Kenji Miyazaki; Ichitaro Ogawa; Hisayoshi Yoshida; Kazuo Kobayashi; Tsuyoshi Hagio; Hidetoshi Ueno; Shigeru Akiyama, all of Tosu, Japan

[73] Assignee: Agency of Industrial Science and Technology, Tokyo, Japan

[21] Appl. No.: 677,019

[22] Filed: Nov. 30, 1984

[30] Foreign Application Priority Data

Dec. 1, 1983 [JP] Japan ..... 58-228080

[51] Int. Cl.[4] ..... B01F 7/00

[52] U.S. Cl. ..... 366/343; 29/156.8 B; 416/241 B

[58] Field of Search ..... 416/241 B; 366/343; 29/156.8 B, 156.8 P

[56] References Cited

U.S. PATENT DOCUMENTS 3,900,668 8/1975 Olcott ..... 416/241 B X

FOREIGN PATENT DOCUMENTS 696715 9/1953 United Kingdom ..... 416/214 B 2112081 7/1983 United Kingdom ..... 416/241 B

*Primary Examiner*—Philip R. Coe

*Attorney, Agent, or Firm*—Oblon, Fisher, Spivak, McClelland & Maier

[57] ABSTRACT

Disclosed herein is a heat resistant vaned stirrer for use in a high temperature atmosphere. To endure stirring operations in high temperature molten metals of 300°-1200° C., the stirrer vanes are formed of a carbon-ceramics composite material which is produced from coke powder blended with 10-50% by volume of ceramics powder and which has a bending strength higher than 200 kg/cm.

6 Claims, 2 Drawing Figures

VANED STIRRER FOR USE IN HIGH TEMPERATURE ATMOSPHERE

BACKGROUND OF THE INVENTION

1. Field of the Invention

This invention relates to a vaned stirrer to be used in molten metal of high temperature or the like, and more particularly to stirrer vanes formed of carbon-ceramics composite material which can sufficiently endure stirring operations in high temperature molten metals of 300° C. to 1200° C. or in other high temperature atmospheres.

2. Description of the Prior Art

Generally, when a metal such as aluminum is melted in crucibles or other containers, a temperature difference occurs between the center and peripheral portions of the containers. Therefore, rotary stir vanes of various shapes have been employed on such occasions in order to provide a more uniform temperature distribution. Further, similar rotary stirrer vanes are also necessitated when unformly admixing various substances into molten metals.

However, the conventional molten metal stirrers which have thus far been employed for these purposes are mostly of metallic vanes consisting of steel plates or the like, which tend to melt away gradually from their outer ends during rotation in molten metal of high temperature, giving rise to a problem that the stirring condition is changed upon time lapses. On the other hand, the stirring vanes which are formed of carbon are exempt from the melting problem, but they undergo considerable wear by aerial oxidation when lifted up from the molten metal after a stirring operation and are cooled in the air, which limit the repeated use of the vanes to a certain number of times. With regard to stirring vanes of ceramics alone such as aluminum oxide, there is a problem that the vanes are apt to be ruptured by thermal shocks when suddenly lifted up into the air from molten metal of high temperature due to the low resistance efficiency to thermal shock, in addition to the difficulty which is encountered in a machining stage due to the high hardness of ceramic materials. That is to say, there have not yet been developed molten metal stirring vanes which can endure long stirring operations.

Further, recently there is a trend that the industrial furnaces which are used for thermal treatment of metals or the like are operated at higher temperatures to enhance physical andC mechanical properties of products, for example, at high temperatures of 950°–1250° C. In addition, the furnaces of this sort are required to maintain a uniform temperature distribution in the processing atmosphere for quality control. Therefore, there has been a strong demand for heat resistant fans which can endure operation in such high temperature atmospheres.

However, the existing heat resistant fans are mostly of a metallic material so that they are limited to operations at temperatures up to 950° C. at highest. Namely, at the present moment there are no heat resistant fans which can endure higher temperatures.

SUMMARY OF THE INVENTION

It is therefore a primary object of the present invention to provide stirrer vanes which can withstand stirring operations in a high temperature atmosphere such as molten metal of 300° to 1200° C.

It is another object of the present invention to provide heat resistant stirrer vanes which are suitable for use in molten metal of a high temperature without melting troubles and which have sufficient resistance to oxidation and thermal shocks along with bending strength sufficient for machining.

It is still another object of the invention to provide heat resistant stirrer vanes which have a long service life and which can endure long stirring operations in molten metal.

According to the invention, the foregoing objectives are achieved by the provision of heat resistant stirrer vanes formed of a specific carbon-ceramic composite material which possesses required strength and anti-oxidation properties. More specifically, the present invention provides heat resistant stirrer vanes consisting of a carbon-ceramic composite material obtained by sintering carbon or graphite powder blended with 10–50% by volume of ceramic powder and having a bending strength higher than 200 kg/cm$^2$.

The above and other objects, features and advantages of the invention will become apparent from the following description and appended claims, taken in conjunction with the accompanying drawings which show by way of example preferred embodiments of the invention.

BRIEF DESCRIPTION OF THE DRAWINGS

In the accompanying drawings

DESCRIPTION OF PREFERRED EMBODIMENTS

Figure 1:
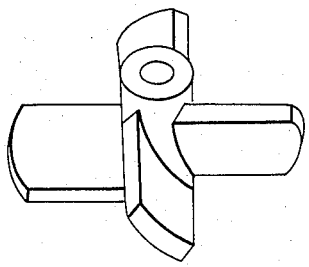
FIG. 1 is a schematic perspective view of a propeller type bladed molten metal stirrer.

Carbon or graphite which is used as a carbon material for the carbon-ceramic composite material of the invention serves to impart excellent resistant to thermal shocks, chemical stability and high temperature strength to the composite material and to reduce its weight, while the ceramic contributes by imparting excellent resistance to oxidation and abrasion along with high mechanical strength.

With regard to the carbon material, the present invention employs coke which is generally adopted as a carbon source, but it is also possible to use a powder of amorphous carbon or artificial graphite.

Examples of ceramic powders according to the invention include powders of boron carbide alone or admixed with other carbides, borides or oxides, preferably carbides and borides of metals belonging to Groups IV, V and VI of the Periodic Table, such as titanium, niobium, tantalum, zirconium, tungsten and silicon, and oxides such as aluminum oxide. Ceramics other than boron carbide may be admixed singly or jointly in a proportion of 10–50% by volume based on the amount of coke. An additive amount of ceramic less than 10% by volume will be reflected by problems such as inferior bending strength and anti-oxidation property, while an additive amount in excess of 50% by volume will be reflected by problems such as degradation in resistance to thermal shock and low machinability.

In a case where boron carbide admixed with other carbides or borides are added as the ceramic powder, it is possible to produce a composite material which has higher strength and smaller electric specific resistance, in comparison with a case where the boron carbide alone is added as the ceramics powder.

The particle sizes of particles of the powdery raw carbonaceous material and ceramic material is preferred to have such a particle size composition which can be compacted to the highest density upon packing the particles to produce a sintered product of the highest density. In this regard, use of coarse powder of coke makes it difficult to produce a composite material of high density and strength, while use of coarse ceramic powder will result in uneven structure and degradation in resistance to thermal shock.

The carbon-ceramic composite material which is to be formed into the heat resistant stirrer vanes according to the present invention is obtained by blending a ceramic powder into coke in the above-mentioned proportion and sintering the blended powder to shape under pressure or under normal pressure. In this connection, the bending strength of the composite material is required to be greater than 200 kg/cm$^2$ to ensure satisfactory strength as stirrer vanes. In order to produce stirrer vanes with a bending strength higher than 200 kg/cm$^2$ by the use of a ceramic powder of boron carbide alone, it is necessary to apply a pressure of about 150 kg/cm$^2$ and to employ a sintering temperature of 2000°–2200° C. The sintering temperature varies depending upon the kind of the ceramic powder and also upon whether the material is sintered under pressure or under atmospheric pressure by the use of raw coke, but it is normally in the range of 1000° C. to 2300° C.

The carbon-ceramic composite material employed in the present invention is low in density and high in strength and has excellent properties in anti-oxidation and resistance to thermal shocks, and exhibits a trend of picking up its bending strength as the temperature is elevated. Accordingly, the stirrer vanes which are formed of the composite material possesses suitable properties for application to molten metals such as aluminum, zinc, lead, copper or the like at high temperatures in the range of 300° C. to 1200° C., as compared with stirrer vanes of metal- or carbon-based material. At temperatures below 300° C., the difference from the carbon-based vanes becomes smaller. On the other hand, if used at temperatures above 1200° C., the service life of the vanes will be shortened to a considerable degree due to degradation in anti-oxidation property.

The service life of the heat resistant stirrer vanes can be prolonged drastically by coating thereon fine powder of an oxide like aluminum oxide.

Figure 2:
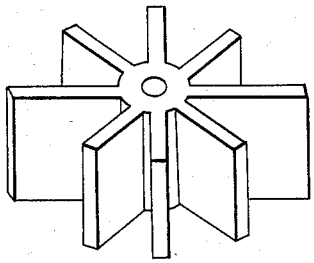
FIG. 2 is a schematic perspective view of a radial type bladed molten metal stirrer.

The heat resistant stirrer vanes according to the present invention can be applied in various forms, for instance, as propeller type vanes as shown in FIG. 1 or as radial type vanes as shown in FIG. 2.

Further, in a case where the stirrer vanes of the present invention is applied to a heat resistant fan, it is necessary to consider, in addition to the durability at the operating temperature, the stress which is applied to the fan primarily by the centrifugal force resulting from rotation of the vane wheel. Since this centrifugal force is proportional to the density, a material of a smaller density is more advantageous than a material of a higher density if the strengths of the two materials are the same. Namely, it is advantageous to have a large specific strength [bending strength (g/cm$^2$)/density (g/cm$^2$)], preferably the specific strength is greater than $600\times10^3$ cm.

The invention is illustrated more particularly by the following examples.

Example 1

Boron carbide powder was blended into calcined pitch coke powder in a proportion of 30% by volume, and the resulting powder mixture was sintered at 2200° C. under pressure of 200 kg/cm$^2$ to obtain a carbon-ceramic composite material. Stirrer vanes produced from this composite material, as well as stirrer vanes produced from a commercially available graphitic material and a steel plate were subjected to a test repeating the procedures of stirring molten aluminum of 800° C. for 30 minutes and lifting up and cooling off the stirrer vanes to room temperature in the air, each time checking for reduction in thickness of the vane portions. The results are shown in Table 1.

TABLE 1

| Reductions (mm) in thickness of vane portions by repeated stirring operation | | | | | |
|---|---|---|---|---|---|
| | Number of operations* | | | | |
| Vane material | 1 | 4 | 6 | 8 | 10 |
| 70 vol % carbon - 30 vol % boron carbide | 0.00 | 0.00 | 0.00 | 0.00 | 0.00 |
| Commercially available graphite material (A) | 0.10 | 0.36 | 0.55 | 0.75 | 1.29 |
| Commercially available graphite material (B) | 0.20 | 0.51 | 0.91 | 1.45 | 1.74 |
| Steel plate | Melted entirely. | | | | |

*One operation consisted of instantly immersing vanes in molten aluminum of 800° C. from room temperature, stirring for 30 minutes at 620 r.p.m., and lifting up and cooling vanes to room temperature in the air. Vanes of steel plates were 3 mm in thickness while vanes of other materials were 5 mm. All vanes had dimensions of 17 mm (l) × 17 mm (w).

Example 2

The stirring operation as in Example 1 was repeated for six times by the use of vanes of the same carbon-ceramic composite material and commercially available graphitic materials (A) and (B). The vanes of the commercially available graphitic materials were broken upon contacting a wall of the crucible which held the molten aluminum when they were lifted up, while the vanes of the carbon-ceramic composite material were not.

Example 3

After applying an alumina base mold facing agent to vanes of the same carbon-ceramic composite material (boron carbide content=30 vol %), the vanes were used for stirring molten aluminum of 800° C. for 30 min. at a speed of 620 r.p.m. and then lifted up and cooled to room temperature in the air. After repeating this operation for 150 times, there was observed no vane damage due to aerial oxidation or the like.

What is claimed is:

1. A heat-resistant vaned stirrer having a bending strength greater than 200 kg/cm$^2$ and formed from a carbon-ceramic, composite material prepared by a process comprising:

sintering carbon or graphite powder which is blended with 10–50% by volume of a ceramic powder which consists of boron carbide alone or boron carbide and at least one member selected from the group consisting of carbides, borides and oxides.

2. The heat-resistance vaned stirrer of claim 1, wherein the vanes of said stirrer have a fine powder coating of aluminum oxide on the surfaces thereof.

3. The heat-resistant vaned stirrer of claim 1, wherein said carbide is silicon carbide, said boride is titanium boride and said oxide is aluminum oxide.

4. The heat-resistant vaned stirrer of claim 1, wherein said carbide or boride is a compound of titanium, niobium, tantalum, zirconium, tungsten or silicon.

5. The heat-resistant vaned stirrer of claim 1, wherein said ceramic powder is boron carbide alone, and said sintering temperature ranges from 2000°-2200° C. under a pressure of 150 kg/cm$^2$.

6. The heat-resistant vaned stirrer of claim 1, wherein said sintering temperature ranges from 1000° C. to 2300° C.

* * * * *